United States Patent [19]

Child

[11] Patent Number: 4,778,361

[45] Date of Patent: Oct. 18, 1988

[54] VARIABLE OUTPUT GEROTOR PUMP

[75] Inventor: Robin E. Child, Leamington Spa, England

[73] Assignee: Concentric Pumps Limited, Birmingham, England

[21] Appl. No.: 80,435

[22] Filed: Jun. 23, 1987

[30] Foreign Application Priority Data

Jul. 7, 1986 [GB] United Kingdom ..... 8616488

[51] Int. Cl.[4] ..... F04C 2/10; F04C 15/04

[52] U.S. Cl. ..... 418/20; 418/22; 418/171

[58] Field of Search ..... 418/19, 20, 166, 171, 418/22; 74/665 GA

[56] References Cited

U.S. PATENT DOCUMENTS

| | | | |
|---|---|---|---|
| 2,490,115 | 12/1949 | Clarke | 418/19 |
| 2,790,391 | 4/1957 | Holl | 418/22 |
| 3,122,946 | 3/1964 | Hedges | 74/665 GA |
| 4,406,599 | 9/1983 | Stephan | 418/22 |
| 4,439,117 | 3/1984 | Bunger | 418/22 |

FOREIGN PATENT DOCUMENTS

| | | | |
|---|---|---|---|
| 76033 | 4/1983 | European Pat. Off. | 418/20 |
| 174734 | 3/1986 | European Pat. Off. | 418/171 |

*Primary Examiner*—John J. Vrablik

*Attorney, Agent, or Firm*—Learman & McCulloch

[57] ABSTRACT

A variable output gerotor oil pump of the kind having a common rotor with n teeth meshed with two axially juxtaposed internally lobed annuli with n+1 teeth has the annuli individually located in eccentrics formed with gear teeth to be turned in opposite directions by a gear drive. The teeth are straight cut, not bevel, and the drive includes an intermediate pinion so that a single shaft turns the eccentrics in opposite directions.

3 Claims, 4 Drawing Sheets

VARIABLE OUTPUT GEROTOR PUMP

This invention relates to gerotor oil pumps of the kind in which an externally lobed rotor turns in and with an internally lobed annulus having a larger number of lobes, and the annulus is divided into two axially juxtaposed portions each in a corresponding eccentric having an external bevel gear set driven from a common bevel pinion so that the eccentrics can be simultaneously turned in opposite directions. This varies the displacement of the pump because of the shift in location of the chambers, defined between the inner and outer rotating parts, and the ports which form inlet and outlet passages respectively. Such an oil pump is to be found in E.P. No. 0076033A. However, the version illustrated in the said E.P. is found unsatisfactory because of the loading applied to the eccentrics which makes them difficult to rotate. In E.P. No. 0174734A, the difficulty in turning is overcome by using needle rollers between the eccentrics and the pump body in which they are to turn. But that pump has been found difficult to manufacture economically.

Moreover, the bevel teeth occupy a certain axial dimension on each eccentric, which means that the construction can only be used where a particular axial rotor length is exceeded. This happens to exclude many of the possible output ratings for which such pumps would otherwise be useful.

The object of the invention is to solve these problems.

According to the invention, an oil pump of the kind referred to is characterised by the provision of straight spur pinions provided on said eccentrics, a drive pinion rotatable about an axis parallel to that of said rotor meshed with one of said spur pinions, and an intermediate pinion also rotatable about a parallel axis effective between the other of said spur pinions and the drive to the intermediate pinion.

This has the advantage of enabling a smaller part of the axial thickness of the eccentric to be used for drive transmission and a larger part for the bearing. This is because the height of the gear tooth is located radially, and can be accommodated without any difficulty in the thickness of the eccentric even at its minimum radial dimension, instead of being located axially. It thus extends the range of usefulness of such pumps. In practice it also means that caged rollers can be used, which are far simpler to assemble.

One possibility for the drive gear arrangement is for the drive pinion to mesh directly with one eccentric spur pinion and also with the intermediate pinion which is itself meshed with the other eccentric spur pinion, in order to bring about the movement of the two eccentrics in opposite directions. In another possibility, a shaft carries a pair of drive pinions which are axially spaced, one of which meshes directly with one eccentric and the other of which meshes with an intermediate pinion to drive the other eccentric.

In the prior art (the mentioned European Patents) a single pinion was inserted between two facing sets of gear teeth on the respective eccentrics and meshed with both so as to drive them in opposite directions. This necessitated bevel teeth in order to get good meshing, which in turn made it difficult to journal the drive pinion against load. Also the volume taken up by the drive pinion both radially of the rotor axis and also parallel to the rotor axis restricted space available for the needle bearings in the arrangement of the E.P. No. 0174734A.

These are only two of the design constraints resulting from the use of the single drive pinion and it is now found that both of these and others, are avoided by the present invention as will be better understood after consideration of the following description of presently preferred embodiments, wherein.

Figure 1:
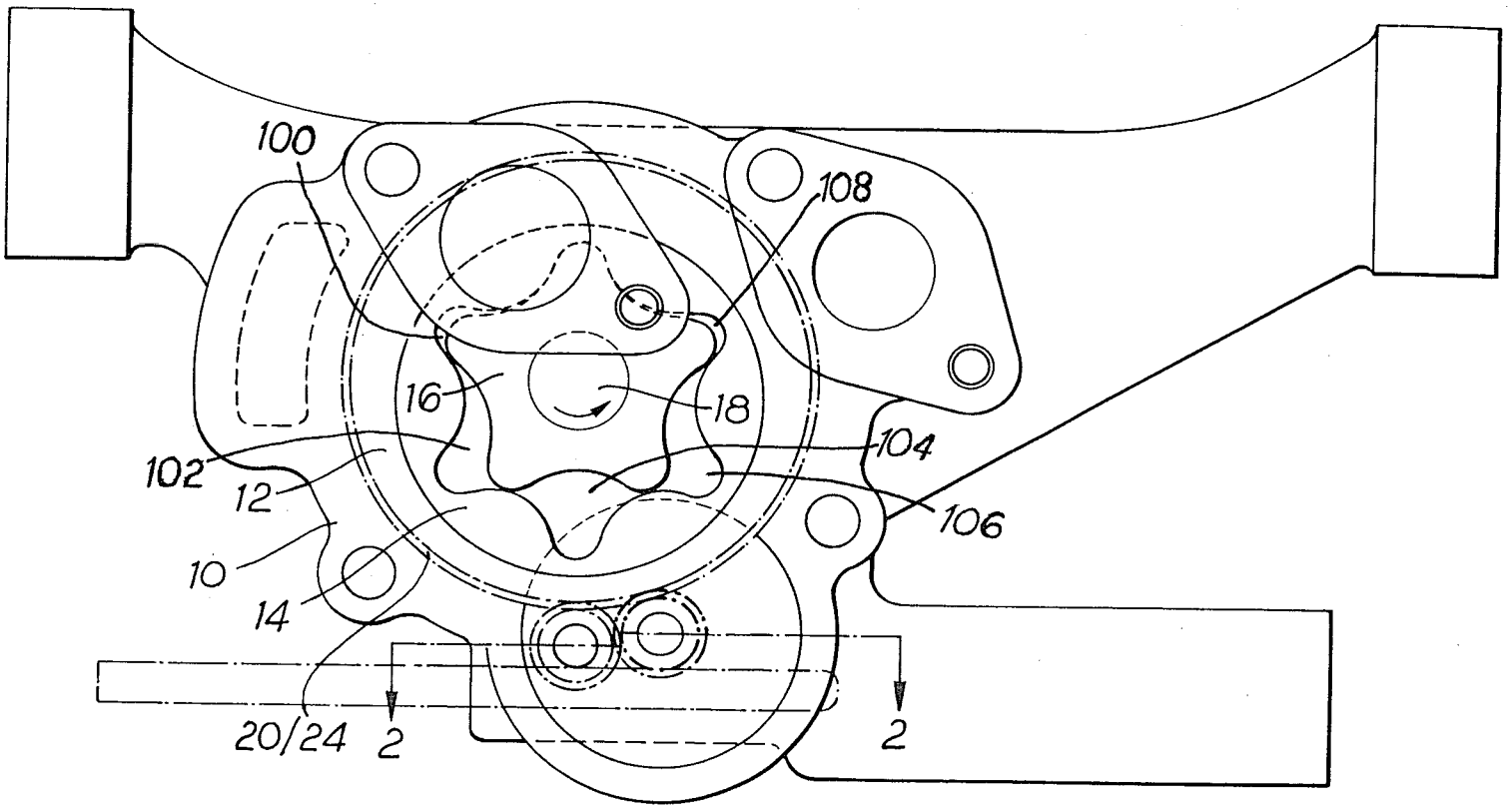
FIG. 1 is a somewhat diagrammatic elevation of a first embodiment.
Figure 2:
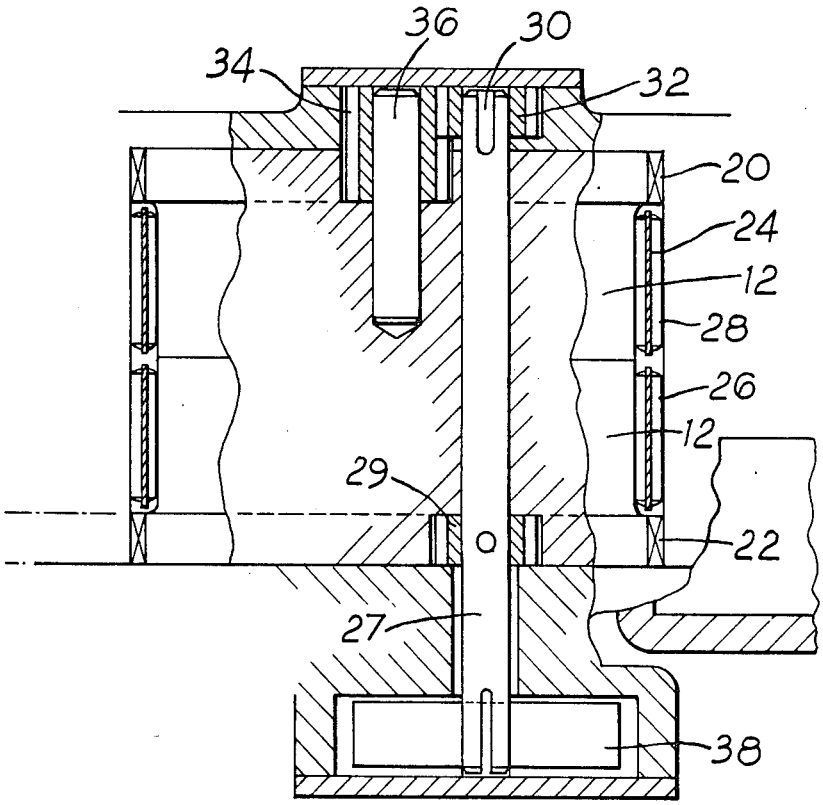
FIG. 2 is a sectional plan on the line 2—2 of FIG. 1.

Turning now to the drawings and particularly FIGS. 1 and 2 thereof, the part 10 forms a casing for the pump and houses the eccentrics 12 which in turn receive the internally toothed or lobed annulus 14 surrounding the rotor 16. The externally lobed rotor 16 has five and the annulus 14 has six teeth. However other numbers are possible. The rotor is driven in the direction of the arrow by shaft 18.

The rotor 16 is a single component but the annulus 14 comprises a pair of annular components located axially side by side, and each annulus is located in a corresponding eccentric.

Figure 3:
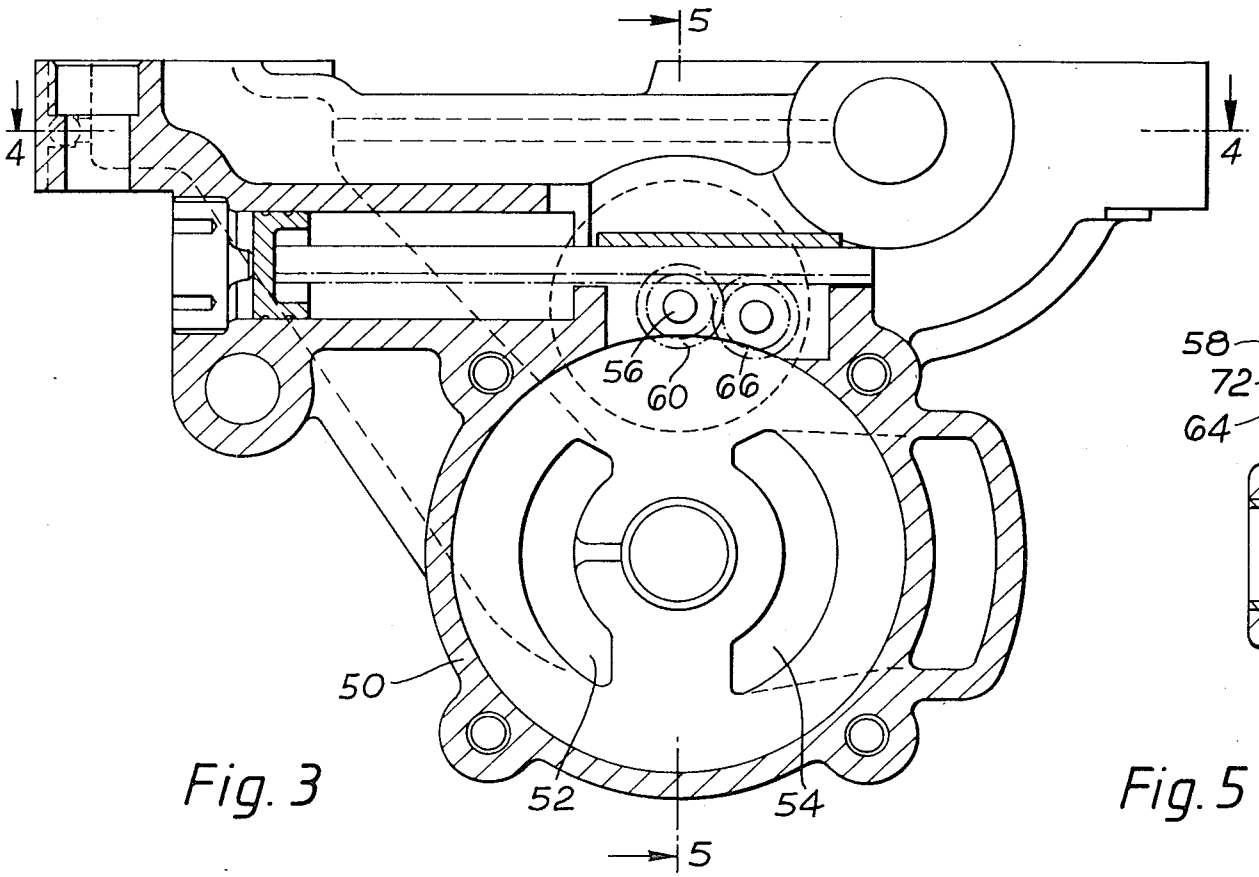
FIG. 3 is a view similar to FIG. 1 of the second embodiment.

FIG. 3 shows the pair of ports 52, 54, which provide the inlet and outlet of the pump. The gerotor pump operation principle, as is well understood by one skilled in the art, is that rotation of the rotor 16 in the direction of the arrow shown in FIG. 1 leads to an endless series of chambers being moved across the inlet port. Each chamber consists of the cavity or space between the rotor 16 and the meshed annulus 14 as bounded (in the direction of rotation) between two pairs of meshed lobes. Thus, in FIG. 1 a small chamber 100 is visible which is approximately aligned with the first end of the inlet port and a second chamber 102 of larger size with the main area of the same inlet port. As the rotor turns, and the annulus turns with it at different speed because of the difference in number of lobes or teeth, the effect is that the volume of the chamber increases as it moves across the inlet port, thus lowering pressure in that chamber and sucking in the pumped fluid. When the chamber achieves a maximum size it moves out of register with the inlet port to the position of chamber 104. Then the chambers move across the outlet port in the same way and as they pass via the positions of the chamber 106 to that of the chamber 108 they reduce in volume and hence expel the fluid through the outlet port.

The output of the pump is a maximum when a line containing the axis of the rotor 16 and the axis of the annulus 14 is symmetrically disposed between the ports as viewed in FIG. 3. The eccentricity of the ring 12 permits the axis of the annulus to be displaced relative to that position. Thus if the eccentric is turned anticlockwise in FIG. 1, for example through an arc of about 30°, the effect will be that the chambers will not be of minimum or zero volume when first aligned with the inlet port. On the contrary, they will be of a larger size, but reducing so as to pass through the zero condition while aligned with the inlet port. Then they will increase as the progression continues, but they will not reach maximum volume until after passing the port. Hence less fluid will be contained in the chamber when it passes from the one port to the other. Moreover, the chamber may still be increasing in volume as it travels over the output port and it may suck back through that chamber before the reduction in volume commences and expulsion from the chamber begins. When the chamber leaves the outlet port it will still have a definite volume instead of being reduced to zero. A similar effect is obtained by turning the eccentric in the opposite direction; although the chambers aligned with the inlet may then achieve maximum volume while still so aligned, they will not be at minimum volume when first placed in communication with the inlet and will begin to reduce in volume while still aligned with the inlet, and so on.

In the twin annulus pump of the present invention each chamber is composed of two communicating portions because of the two annuli meshed with the common rotor. At maximum output the two annuli are wholly aligned and the arrangement is as earlier described so that each zero volume chamber registers with the beginning of the inlet port and each maximum volume chamber leaves the inlet port and is at maximum volume when it first aligns with the outlet port and so on. As the eccentrics turn in opposite directions, the axes of the annuli are displaced out of coincidence and hence the effectiveness of the pump or, in other words the output, will vary from a maximum when the eccentrics are aligned with one another and in the position for maximum effectiveness of their individual annuli, and to a minimum when displaced (to the greatest extent possible in the given design) therefrom.

As best seen in FIG. 2, each eccentric 12 is provided with straight cut spur pinion teeth 20, 22, and between the pinion teeth, is located two axially extending end-to-end independently caged sets of roller bearings 26, 28. The needle roller bearings are effective between the two eccentric components 12 and the casing 10.

The location of the needle roller bearing and the teeth is diagrammatically indicated in FIG. 1 by the reference 20/24.

The drive arrangements are best shown in FIG. 2. Drive shaft 27 is pinned to straight cut pinion 29 meshed with the gear ring 22. It is also keyed at 30 to a further such pinion 32 which is in turn meshed with pinion 34 journalled on shaft 36 and meshed with gear ring 20. It will be appreciated that when the shaft 27 turns, pinions 29 and 34 turn in opposite directions and likewise for the gear rings 20, 22 and hence the two eccentrics 12.

A clock spring 38 or another torsion spring is provided and connected to the shaft 27 for example to return the same to a position in which the eccentricity is at a maximum.

Figure 5:
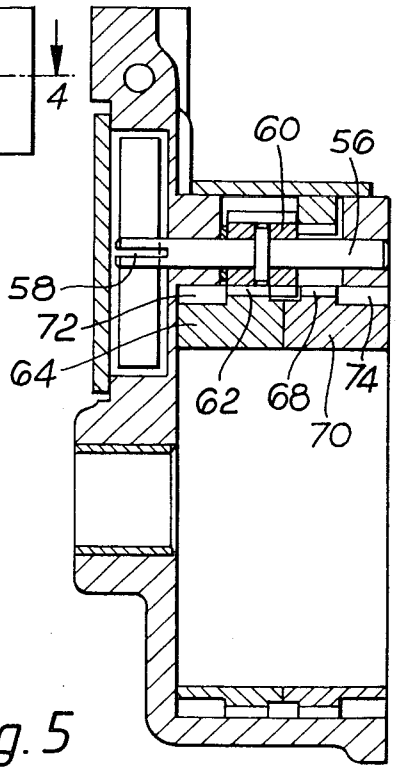
FIG. 5 is a sectional elevation on the line 5—5 of FIG. 3.
Figure 4:
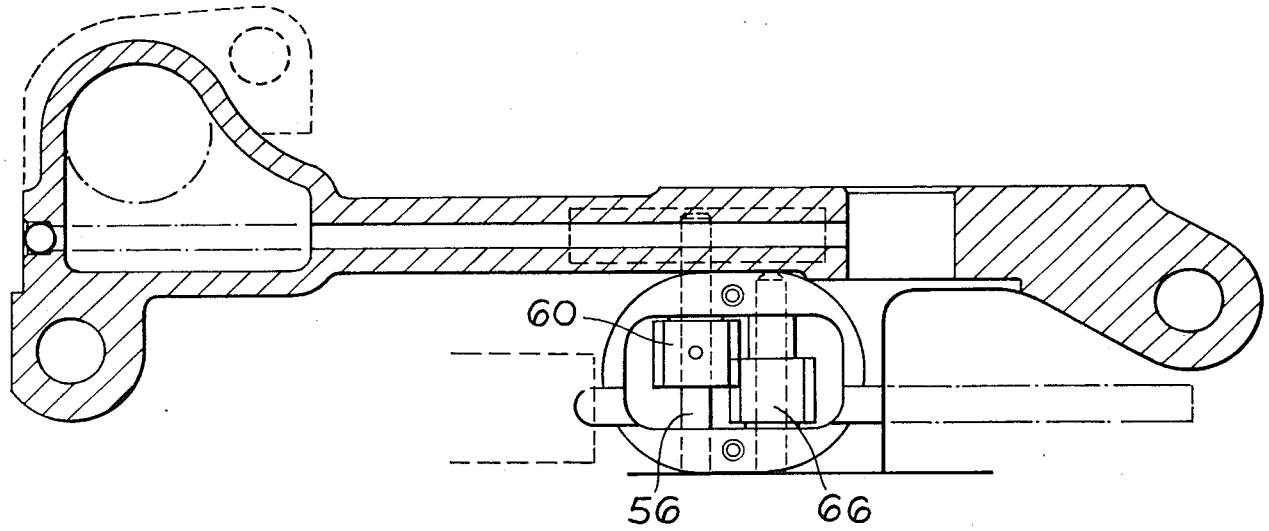
FIG. 4 is a sectional plan on the line 4—4 of FIG. 3.

In the arrangement shown in FIG. 3, from which the eccentrics, annuli and rotor are omitted for clarity, the casing 50 is provided with the outlet and inlet ports 52, 54 and in this case drive shaft 56 (FIG. 5) is connected to the return spring by the slot 58 at one end, and carries pinion 60 meshed with gear ring 62 on the eccentric sheave 64 (only shown in FIG. 5) and the same pinion 60 also meshes with a second pinion 66 (FIG. 4) on a parallel shaft and that second pinion in turn meshes with a gear ring 68 on the second annuli 70 (FIG. 5). In this case the spaces 72, 74 accommodate completely separate caged needle roller bearing sets to journal the two annuli 64, 70.

Having now described my invention what I claim is:

1. A variable output gerotor pump comprising a pump body having inlet and outlet ports therein, an externally lobed rotor, a pair of side-by-side internally lobed annuli, each of said annuli having a greater number of lobes than said rotor, said rotor extending in meshed engagement through said annuli, a pair of eccentric rings each of which accommodates one of said annuli, and driving means for rotating said rings to displace the annuli relative to said inlet and outlet ports and vary the pump output, said driving means comprising a straight spur gear on each of said rings, a common drive shaft parallel to the axis of said rotor, and straight cut pinions between the drive shaft and the eccentric rings for transmitting drive from the shaft to the rings in opposite directions.

2. A pump according to claim 1 in which said driving means comprise a first drive pinion fast with said drive shaft and meshed with one of said eccentric rings, and an intermediate pinion carried on a shaft parallel to said drive shaft and meshed with said first drive pinion and with the other of said eccentric rings.

3. A variable output gerotor pump comprising a pump body having inlet and outlet ports therein, an externally lobed rotor, a pair of side-by-side internally lobed annuli, each of said annuli having a greater number of lobes than said rotor, said rotor extending in meshed engagement through said annuli, a pair of eccentric rings each of which has gear teeth thereon, bearing means journalling one eccentric ring in said pump body, separate bearing means journalling the other eccentric ring in the pump body, each of said annuli being accommodated in a corresponding one of said rings, and driving means for rotating said rings to displace the annuli relative to said inlet and outlet ports and vary the output of said pump, said driving means comprising a common drive shaft, a pinion set for transmitting drive from said drive shaft to one of said rings in one direction and for transmitting drive from the drive shaft to the other of the rings in the opposite direction, said pinion set comprising a drive pinion fast with said drive shaft and meshed with one of said eccentric rings and an intermediate pinion also meshed with said drive pinion and with the other of said eccentric rings, all of said gears and said eccentric rings having straight cut gear teeth.

* * * * *